US006866116B2

(12) United States Patent
Peng

(10) Patent No.: US 6,866,116 B2
(45) Date of Patent: Mar. 15, 2005

(54) STRUCTURE FOR QUICK-ASSEMBLY CABINET

(75) Inventor: Jack Peng, Taipei (TW)

(73) Assignee: Meiloon Industrial Co., Ltd., Taipei (TW)

( * ) Notice: Subject to any disclaimer, the term of this patent is extended or adjusted under 35 U.S.C. 154(b) by 202 days.

(21) Appl. No.: 10/299,717

(22) Filed: Nov. 20, 2002

(65) Prior Publication Data

US 2004/0094358 A1 May 20, 2004

(51) Int. Cl.[7] ..... A47B 81/06
(52) U.S. Cl. ..... 181/199; 181/198
(58) Field of Search ..... 181/199, 198, 181/200, 175, 179, 189, 190, 184, 186

(56) References Cited

U.S. PATENT DOCUMENTS 3,715,008 A * 2/1973 Lover ..... 181/147
6,005,957 A * 12/1999 Meeks ..... 381/386
6,142,254 A * 11/2000 Claybaugh et al. ..... 181/199

* cited by examiner

*Primary Examiner*—Kimberly Lockett
(74) *Attorney, Agent, or Firm*—Troxell Law Office, PLLC

(57) ABSTRACT

The present invention relates to an improved structure for quick-assembly cabinet; and comprises a cabinet with a loudspeaker provided thereon. The first side of cabinet is provided with a loudspeaker holder and the second side opposite to the loudspeaker holder is provided with a screw hole. Loudspeaker stand is provided with an expansion plate larger than the foregoing loudspeaker holder; and the back of magnetic loop is provided with a pair of screw holes that allow screw to penetrate from behind the box to fix the loudspeaker. The loudspeaker holder and loudspeaker stand are provided with joints and openings, respectively. Thus the sound box can be assembled faster and no screws are needed on the front side of loudspeaker and, therefore, the production efficiency is significantly improved and the cabinet looks more attractive than conventional cabinets.

5 Claims, 5 Drawing Sheets

STRUCTURE FOR QUICK-ASSEMBLY CABINET

BACKGROUND OF THE INVENTION

1. Field of the Invention

The present invention relates to an improved structure for quick-assembly cabinet, especially referring to the cabinet that requires less locking-motions than conventional cabinets and has no screws on the front side of loudspeaker as opposed to the conventional cabinets and, therefore, can be produced more efficiently and the appearance looks more attractive than conventional cabinets.

2. Description of the Prior Art

Cabinet is the indispensable output device for the stereo assembly. The conventional cabinet is made up of wooden plates and is provided with a loudspeaker holder on the front to accommodate the loudspeaker; and the stand is fixed in the cabinet with four screws penetrating through four corners of the stand. Presently, cabinets are made up of either plastic or metal. However, the assembly method remains unchanged and, consequently, following disadvantages are apparent:

1. Each loudspeaker requires four screws. If a cabinet is connected to several loudspeakers, the number of screws increases by several times in order to fix all loudspeakers securely, which is time-consuming and labor-consuming;
2. The screws provided on the front side of cabinet are visible. The cabinet has to be covered with a net for attractive purpose. The design of appearance will be limited.

As a result of design improvement, now a number of cabinets and stands are provided with buckles or zig-zag edges to facilitate assembly. However, the structure is too complicated and the products have to be manufactured precisely. The size of loudspeaker holder and the shape of stand are apt to change and the cabinet and loudspeaker may not be assembled properly if different materials are used or the thickness of materials is changed, which affects the production efficiency.

The purpose of present invention is to reduce the number of screws needed by the cabinet and to eliminate screws from the front side of loudspeaker, thereby improving the structure of cabinet, making the cabinet look attractive, and upgrading the production efficiency.

SUMMARY OF THE INVENTION

The present invention comprises a cabinet with a loudspeaker provided thereon. To serve the foregoing purpose, the first side of cabinet is provided with a loudspeaker holder and the second side opposite to the loudspeaker holder is provided with a screw hole. Loudspeaker stand is provided with an expansion plate larger than the foregoing loudspeaker holder; and the back of magnetic loop is provided with a pair of screw holes that allow screw to penetrate from behind the box to fix the loudspeaker. The loudspeaker holder and loudspeaker stand are provided with joints and openings, respectively. Thus the sound box can be assembled faster and no screws are needed on the front side of loudspeaker and the production efficiency is, therefore, significantly improved.

Other advantages of the invention will be evident from the following detailed description when read in conjunction with the accompanying drawings that illustrate the preferred embodiment of the invention.

DETAILED DESCRIPTION OF THE PREFERRED EMBODIMENT

Figure 1:
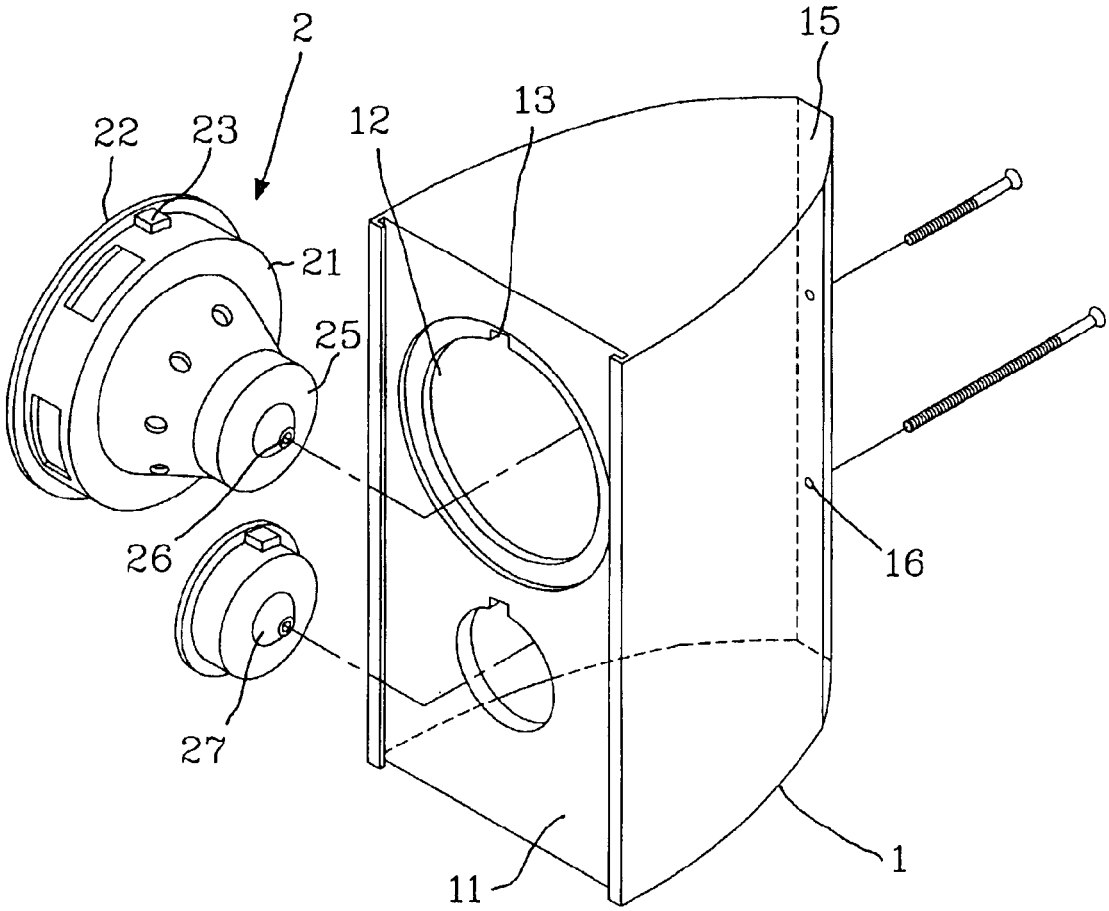
FIG. 1 is a stereoscopic sectional view of present invention.
Figure 2:
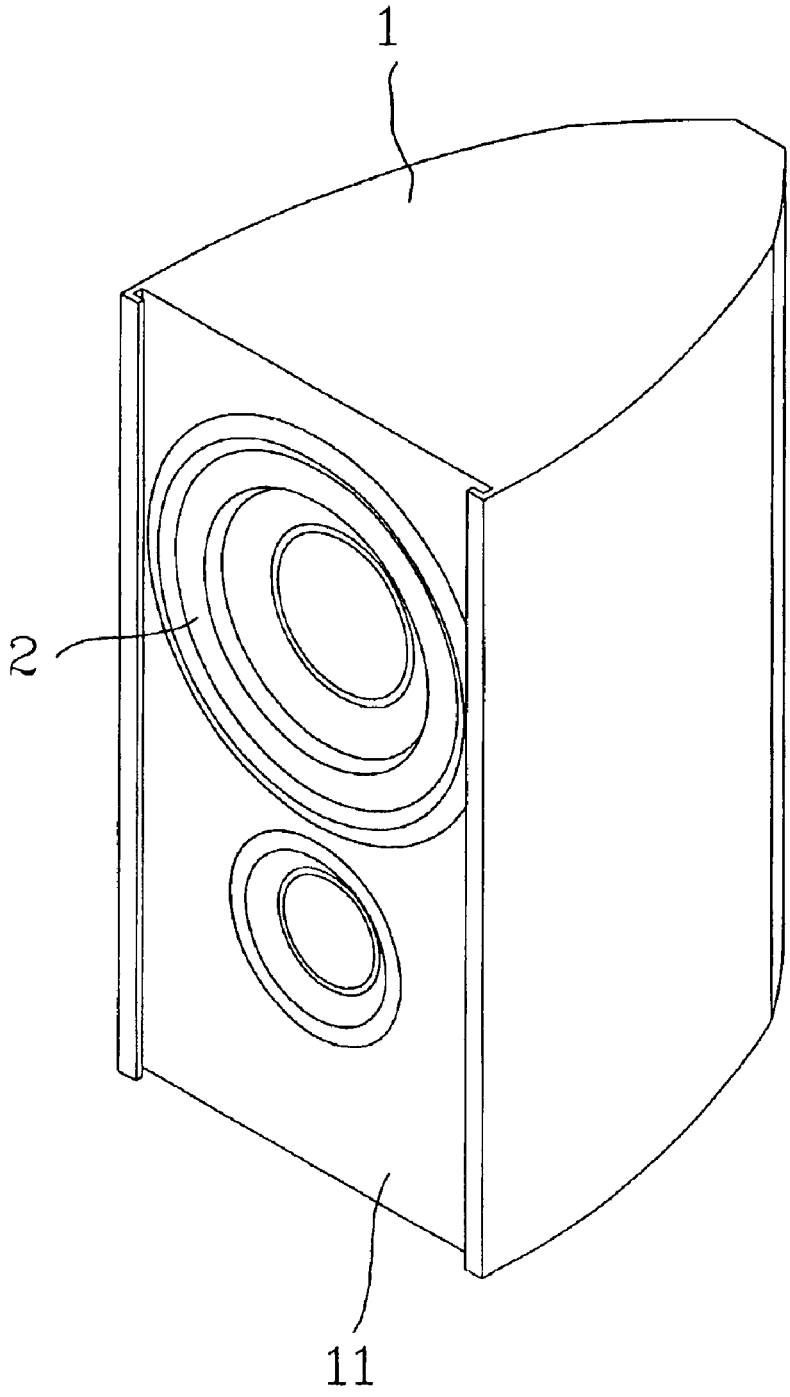
FIG. 2 is a stereoscopic external view of present invention.

Referring to FIGS. 1 through 5, the improved structure for quick-assembly cabinet comprises a cabinet 1 with a loudspeaker 2 provided thereon. Of which, a cabinet 1 is provided with a loudspeaker holder 12 on the first side 11; and a screw hole 16 is provided on the second side 15 opposite to loudspeaker holder 12;

a stand 21 of loudspeaker 2 is provided with an expansion plate 22 larger than the foregoing loudspeaker holder 12; a pair of screw holes 26 are provided on the back of magnetic loop 25; and the loudspeaker holder 12 and loudspeaker stand 21 are provided with joints 23 and openings 13, respectively.

When in use; first side 11 and the second side 15 of cabinet 1 are placed in an even position. The first side 11 is larger than the second side 15; and both ends are provided in arc shape. The first side 11 is provided with a large loudspeaker holder and a small loudspeaker holder 12; the foregoing opening 13 is provided above the loudspeaker 12; the joint 23 of loudspeaker 2 is placed on both stand 21 and edge 22; and a round-protuberant seat 27 is provided on the center of magnetic loop 25 behind the loudspeaker 2 to accommodate the screw hole 26.

Figure 3:
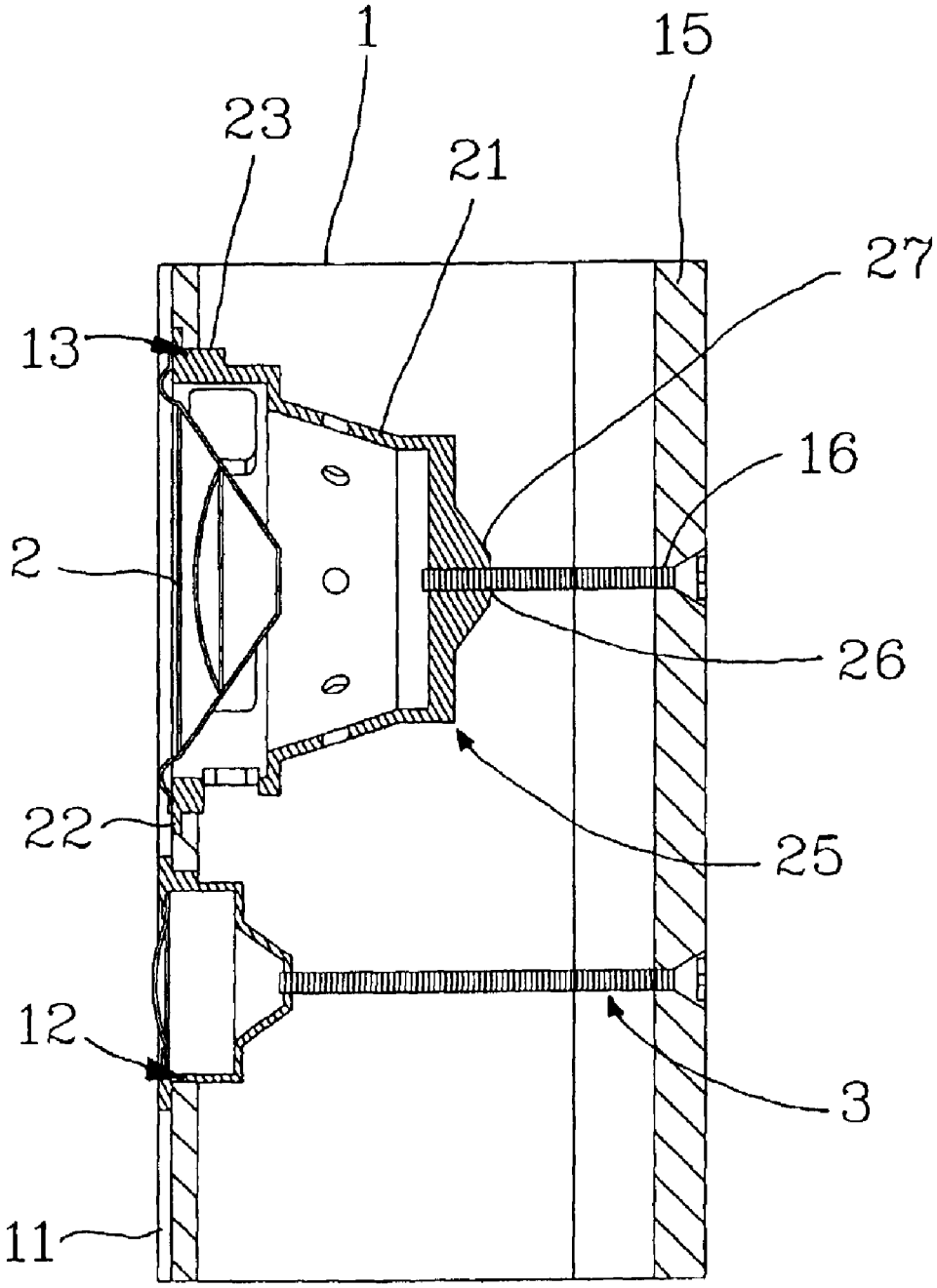
FIG. 3 is a plan view of present invention.

As shown by FIGS. 1 and 3, to assemble the loudspeaker 2 and the cabinet 1, just place the loudspeaker 2 into the loudspeaker holder 12 and make sure that the joint 23 of stand 21 is placed right into the opening 13 and insert screw 3 from the screw hole behind the cabinet 1 into the screw hole 26 on the back of loudspeaker 2 in order to fix the loudspeaker 2 quickly.

The loudspeaker 2 is fixed without incurring deflection when join 23 and the opening 13 are assembled to fix on the right position. Only one screw 3 is needed for assembling each loudspeaker 2. Therefore, production efficiency is upgraded. Without screw on the front, the loudspeaker 2 looks more attractive than conventional cabinets. The cabinet can be designed more freely and flexibly; and users can decide whether to cover the cabinet with a net 4 or not.

Figure 4:
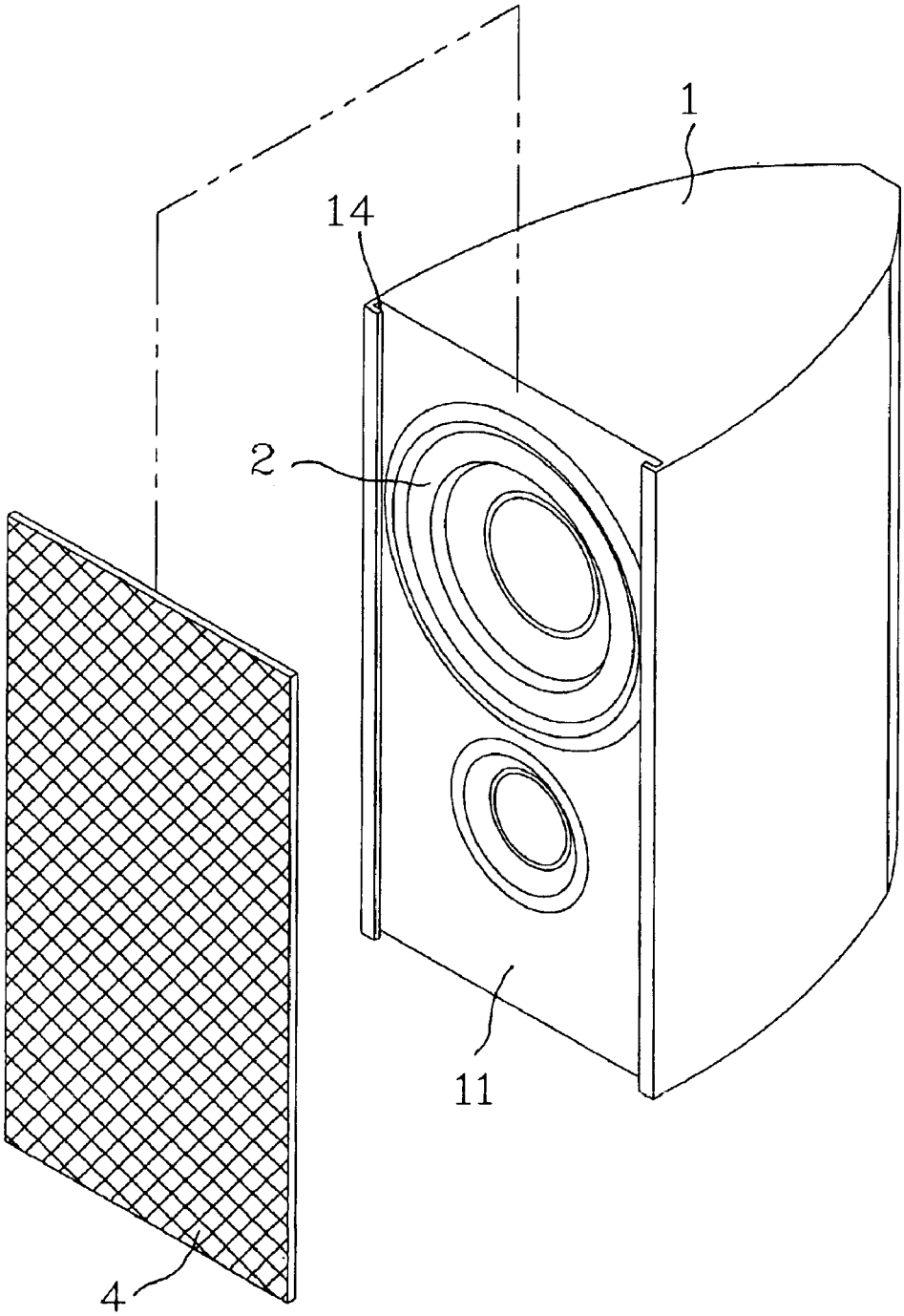
FIG. 4 is a schematic view showing a net provided on the front of present invention.
Figure 5:
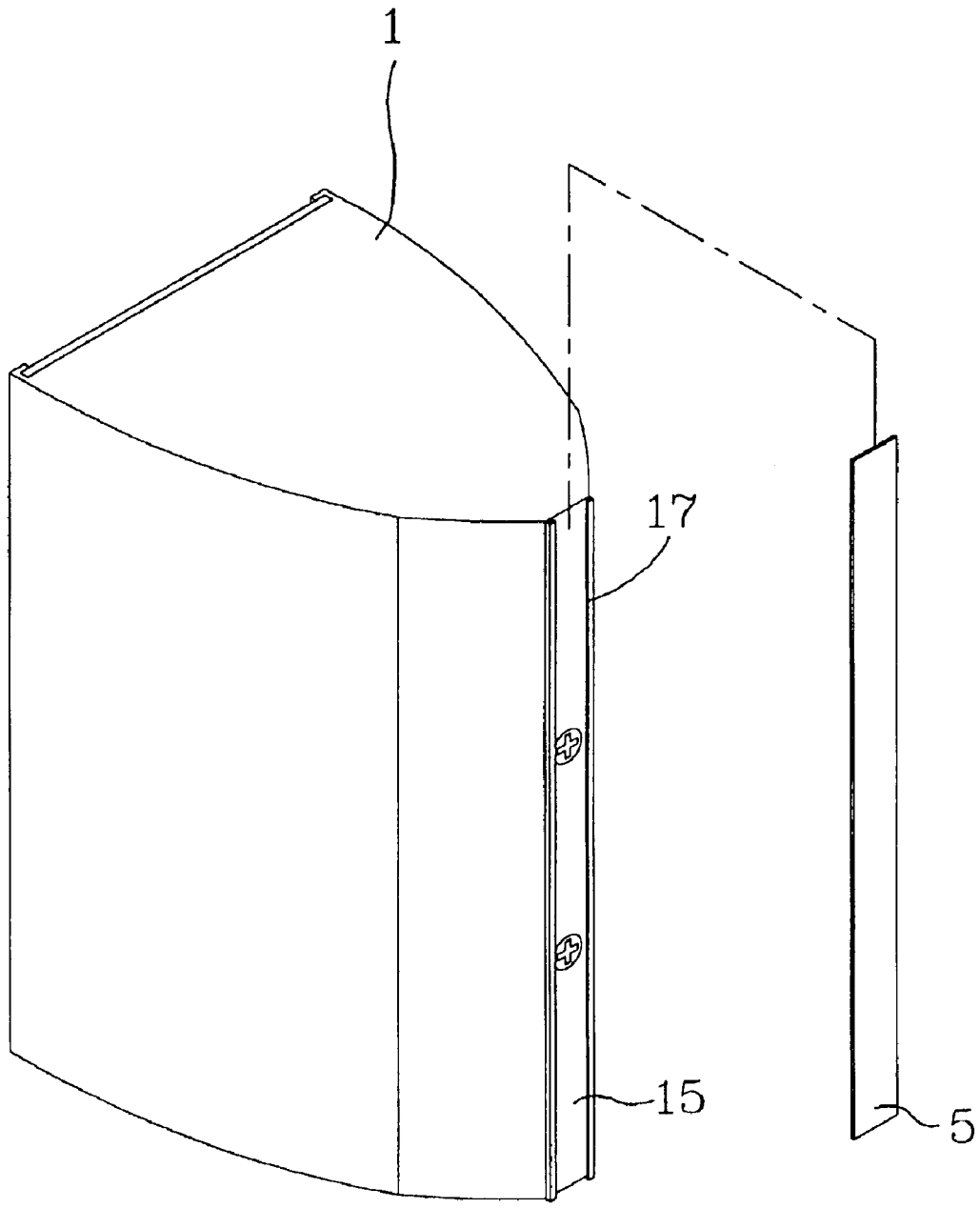
FIG. 5 is a schematic view showing a plate provided on the rear of present invention.

FIGS. 4 and 5 are the schematic views showing a net provided on present invention. The cabinet 1 is made of metal with large front side and small backside. To make the cabinet look attractive, both ends of first side 11 are provided with net tracks 14 that facilitate the installation of net 4 on the front. The second side 15 of the cabinet 1 can be provided (or glued) with track 17 to facilitate the installation of cover 5. Thus screw 3 becomes invisible and, therefore, the cabinet looks more attractive than the conventional cabinets.

The present invention has been described in conjunction with the preferred embodiment to those skilled in the art, modification may be made in the invention without departing from the spirit and scope of the subject invention as set forth in the claims below.

Having thus described the present invention, what the inventor claims as new and desire to be secured by Letters Patent of the United States include:

1. A speaker cabinet assembly comprising:

a) a speaker cabinet having:

i) at least one speaker holder located on a front surface thereof, each speaker holder having an opening; and ii) at least one cabinet screw hole located on a rear surface thereof;

b) at least one loud speaker, each loud speaker inserted into one speaker holder located on the front surface of the speaker cabinet and having:

i) a loudspeaker stand having an expansion plate with an outer diameter larger than an inner diameter of the speaker holder and a joint inserted into the opening of the speaker holder; and ii) a magnetic loop having a speaker screw hole; and c) at least one screw inserted through one of the at least one cabinet screw hole and connected to the speaker screw hole of one of the at least one loud speaker, each of the screws pressing the expansion plate of the one loud speaker against a front of the front surface of the speaker cabinet.

2. The speaker cabinet assembly according to claim 1, wherein: the front surface of the speaker cabinet is larger than the rear surface of the speaker cabinet; each of two side surfaces of the speaker cabinet have an arc shape; the at least one speaker holder includes a smaller speaker holder and a larger speaker holder; and each opening is located above one of the at least one loud speaker.

3. The speaker cabinet assembly according to claim 1, further comprising a net track located on two opposing edges of the front surface, and a net inserted into the net track.

4. The speaker cabinet assembly according to claim 1, wherein the magnetic loop includes a round protuberant seat located on a rear surface thereof, and the speaker screw hole is located in a center of the round protuberant seat.

5. The speaker cabinet assembly according to claim 1, further comprising a cover track located on the rear surface on opposite sides of the at least one cabinet screw hole, and a cover inserted into the cover track.

* * * * *